US006263721B1

(12) United States Patent
Kawano

(10) Patent No.: US 6,263,721 B1
(45) Date of Patent: Jul. 24, 2001

(54) UPPER TOOL HOLDER APPARATUS IN PRESS BRAKE

(75) Inventor: Toshirou Kawano, Kanagawa (JP)

(73) Assignee: Amada Company, Limited, Kanagawa Ken (JP)

( * ) Notice: Subject to any disclaimer, the term of this patent is extended or adjusted under 35 U.S.C. 154(b) by 0 days.

(21) Appl. No.: 09/382,797

(22) Filed: Aug. 25, 1999

(30) Foreign Application Priority Data

Aug. 25, 1998 (JP) ..... 10-239155

(51) Int. Cl.[7] ..... B21D 5/02; B21D 37/04
(52) U.S. Cl. ..... 72/481.6; 72/482.91; 72/462
(58) Field of Search ..... 72/481.6, 482.1, 72/481.2, 482.2, 482.91, 482.92, 462

(56) References Cited

U.S. PATENT DOCUMENTS

| | | | | |
|---|---|---|---|---|
| 5,511,407 | * | 4/1996 | Kawano | 72/482.91 |
| 5,513,514 | * | 5/1996 | Kawano | 72/482.91 |
| 5,572,902 | * | 11/1996 | Kawano | 72/482.91 |
| 5,619,885 | * | 4/1997 | Kawano et al. | 72/481.8 |
| 5,685,191 | * | 11/1997 | Kawano et al. | 72/482.91 |
| 5,794,486 | * | 8/1998 | Sugimoto et al. | 72/481.3 |
| 6,003,360 | * | 12/1999 | Runk et al. | 72/482.2 |

* cited by examiner

*Primary Examiner*—David Jones
(74) *Attorney, Agent, or Firm*—Blank Rome Comisky & McCauley, LLP

(57) ABSTRACT

An upper tool holder apparatus in a press brake includes: a holder main body having an upper tool supporting section for supporting an upper tool a lower portion of the holder main body and further having a mounting; an upper tool clamp supported to the holder main body having an engagement projection at the bottom end of the upper tool clamp which is engaged with a drop-prevention groove provided in the upper tool; a pressing section provided on a lower portion of the upper tool clamp; clamping force applying means for applying a clamping force which clamps the upper tool by pressing an upper portion of the upper tool clamp; clamp operating means for transmitting the clamping force from the clamping force applying means to the upper tool clamp and for releasing the clamping force; and a wedge piece, which is engaged with the drop-prevention groove provided in the upper tool, provided on an upper portion of the engagement projection provided on the lower portion of the upper tool clamp, a force being applied to the wedge piece in a direction where it moves forwards and backwards and it is engaged with the drop-prevention groove. In the construction above, a groove is formed in a front-and-rear direction on a center portion of a right-and-left direction of a lower portion of the mounting plate; and a right-and-left pivoting prevention member which is engaged with the groove is provided on an upper portion of the upper tool clamp.

3 Claims, 4 Drawing Sheets

UPPER TOOL HOLDER APPARATUS IN PRESS BRAKE

BACKGROUND OF THE INVENTION

1. Field of the Invention

The present invention relates to an upper tool holder apparatus in a press brake, and more specifically relates to an upper tool holder apparatus in a press brake which is capable of easily detaching an upper tool from an upper table in the press brake so as to exchange it with new one.

2. Description of Relevant Art

A press brake has an upper table (called also as an upper apron) and a lower table (called also as a lower apron). The upper table and the lower table are arranged in an up-and-down direction so as to face each other. One of the upper table and the lower table is suitably driven up and down as a ram.

In order that the press brake having the above structure bends a plate-shaped workpiece, a lower tool (die) is mounted to an upper portion of the lower table, and an upper tool (punch) is mounted to a lower portion of the upper table.

In the above structure, after the workpiece is located on the die, the upper tool and the lower tool are engaged with each other so that the workpiece can be bent.

Incidentally, when a forward end (lower end) of the upper tool provided on the upper table via an upper tool holder apparatus is brought into contact with a V groove formed in the lower tool so that an origin is set in the press brake with a pressure of 2 to 3 t, for example, being applied, the upper tool is broken in the case where a length of the upper tool is short. For this reason, conventionally an operator lifts the upper tool so as to set the origin, and thus this operation is hard.

In addition, since the upper tool is exchanged in the press brake because of a difference in forms of bent workpieces, for example, a lot of upper tool holder apparatuses are mounted to the lower portion of the upper table, and the upper tool holder apparatuses support the upper tool to the upper table detachably.

The conventional upper tool holder apparatus is constituted so as to mount an upper tool clamp to a holder main body mounted to the lower portion of the upper table via a clamping bolt to be oscillated and firmly fix the upper portion of the upper tool inserted between the upper tool clamp and the holder main body via the upper tool clamp by clamping the clamping bolt.

Incidentally, since the above-mentioned conventional upper tool holder apparatus detaches the upper tool from the upper table to exchange it even if the length of the upper tool is short, a lot of the clamping bolts provided in the upper tool holder apparatus should be operated. As a result, this operation is extremely troublesome. Moreover, since a long wedge member is provided in a right-and-left direction between the upper table and lower tool holder apparatus in order to adjust the height of the upper tool, crowning in a longitudinal direction of the upper tool cannot be adjusted fine.

SUMMARY OF THE INVENTION

The present invention has been achieved with such points in view. It therefore is an object of the present invention to provide an upper tool holder apparatus in a press brake which is capable of simplifying an operation for mounting an upper tool clamp to a holder main body and preventing its rotary movement in a right-and-left direction and easily adjusting a height of an upper tool even if a plurality of especially short upper tool holder apparatuses are used with them being arranged adjacently and simultaneously adjusting crowning.

A first aspect of the invention provides an upper tool holder apparatus in a press brake, comprising: a holder main body to be mounted detachably to an upper table in a press brake, the holder main body having an upper tool supporting section for supporting an upper tool a lower portion of the holder main body, the holder main body further having a mounting plate which is pressed and fixed to an upper table at an upper front surface of the holder main body; an upper tool clamp supported to the holder main body so as to be swung on a vicinity of a center portion in an up-and-down direction, the upper tool clamp having an engagement projection at the bottom end of the upper tool clamp, the engagement projection being engaged with a drop-prevention groove provided in the upper tool; a pressing section provided on a lower portion of the upper tool clamp, the pressing section pressing the upper tool against the upper tool supporting section; clamping force applying means for applying a clamping force which clamps the upper tool by pressing an upper portion of the upper tool clamp, the clamping force applying means being provided on the holder main body; clamp operating means for transmitting the clamping force from the clamping force applying means to the upper tool clamp and for releasing the clamping force; and a wedge piece, which is engaged with the drop-prevention groove provided in the upper tool, provided on an upper portion of the engagement projection provided on the lower portion of the upper tool clamp, a force being applied to the wedge piece in a direction where it moves forwards and backwards and it is engaged with the drop-prevention groove, wherein a groove is formed in a front-and-rear direction on a center portion of a right-and-left direction of a lower portion of the mounting plate; and wherein a right-and-left pivoting prevention member which is engaged with the groove is provided on an upper portion of the upper tool clamp.

Therefore, the engagement projection provide on the lower portion of the upper tool clamp is engaged with the drop-prevention groove provided in the upper tool so that the upper tool is securely prevented from dropping out of the upper tool holder apparatus.

In addition, when the clamping force is transmitted from the clamping force applying means to the upper tool clamp by operating the clamp operating means, the upper tool clamp presses and fixes the upper tool firmly to the upper tool supporting section of the holder main body, and thus the upper tool is fixed securely.

Further, since the wedge piece which is engaged with the drop-prevention groove is provided on the upper portion of the engagement projection provided on the lower portion of the upper tool clamp so as to move forward and backward, a clearance between the drop-prevention groove provided in the upper tool and the engagement projection can be reduced, and thus the upper tool is prevented from dropping more securely.

The groove is formed in the front-and-rear direction on the center portion of the right-and-left direction of the lower portion of the mounting plate, and the right-and-left pivoting prevention member which is engaged with the groove is provided on the upper portion of the upper tool clamp. As a result, the upper tool clamp is prevented from pivoting in the right-and-left direction.

A second aspect of the invention provides an upper tool holder apparatus in a press brake characterized in that the mounting plate and the holder main body are integral with each other.

Therefore, the mounting plate and the holder main body are produced integrally so that they are mounted to the upper table easily and more definite accuracy is secured.

A third aspect of the invention provides an upper tool holder apparatus in a press brake characterized in that a height adjustment wedge member for adjusting a height by means of a pushing bolt and a pulling bolt is provided between the upper table and the holder main body.

Therefore, since the height adjustment wedge member for adjusting a height by means of the pushing bolt and the pulling bolt is provided between the upper table and the holder main body, in the case particularly where short upper tool holder apparatuses are used so as to be adjacent to each other, the respective height adjustment wedge members adjust heights from a front side by means of the pushing bolts and the pulling bolts and simultaneously adjust crowning.

DETAILED DESCRIPTION OF THE PREFERRED EMBODIMENT

There will be detailed below an embodiment of the present invention with reference to the drawings.

Figure 1:
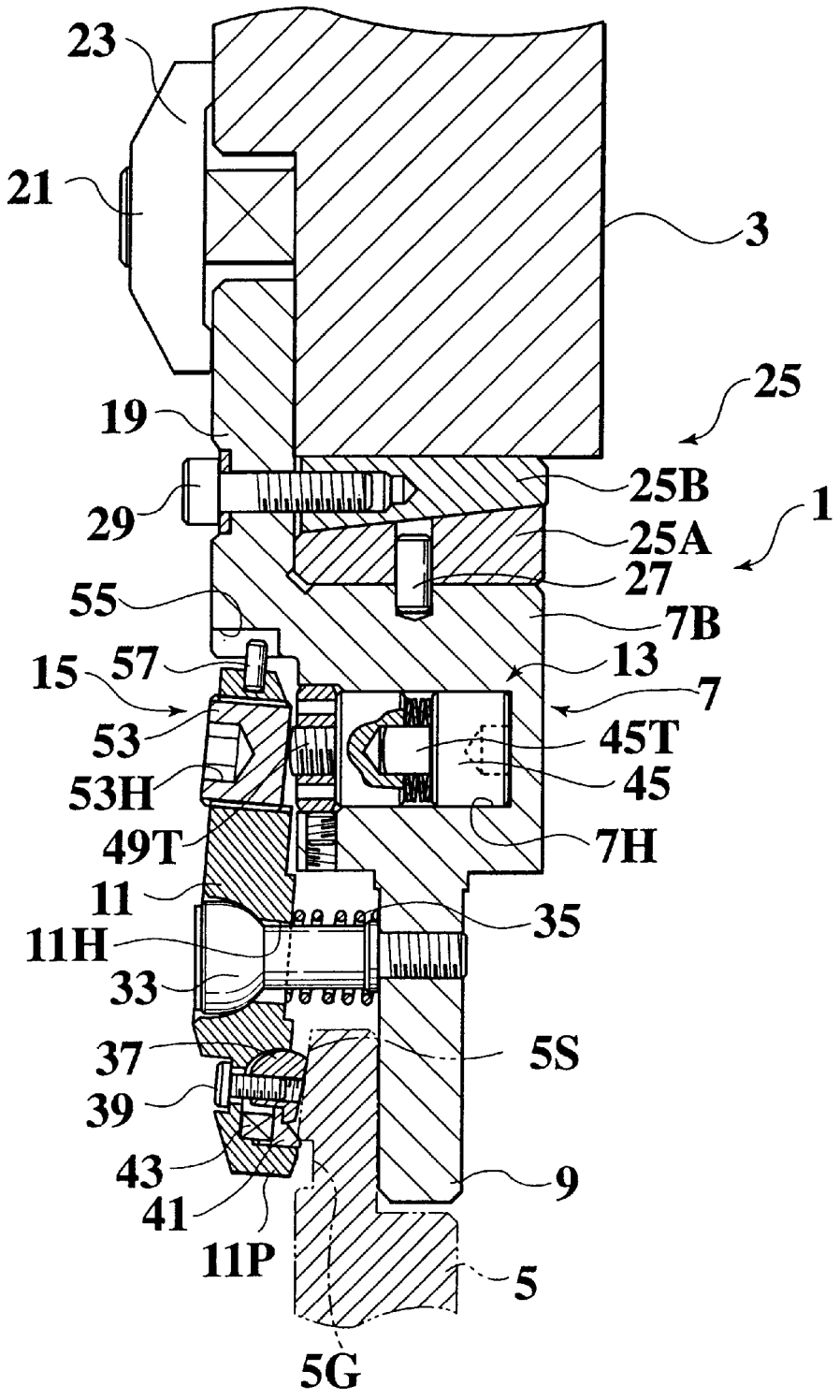
FIG. 1 is a side sectional view of an upper tool holder apparatus of the present invention showing an unclamped state.
Figure 2:
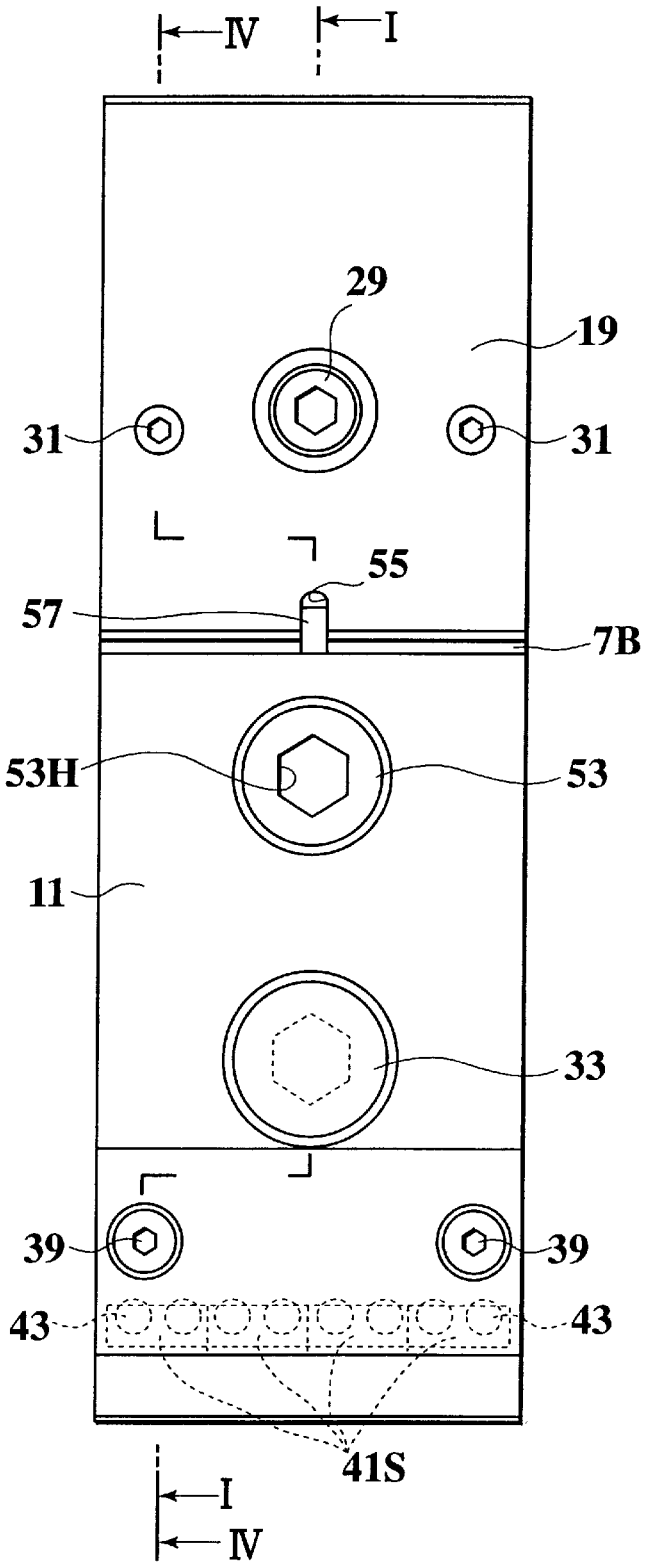
FIG. 2 is a front view of FIG. 1.

As shown in FIGS. 1 and 2, an upper tool holder apparatus 1 according to the present embodiment is mounted detachably to a lower portion of an upper table 3 in a press brake (the overall structure is not shown). A plurality of the upper tool holder apparatuses 1 are mounted to the lower portion of the upper table 3 with suitable intervals in a right-and-left direction.

Namely, an upper tool 5 in the press brake is such as one upper tool which is long in a right-and-left direction (direction vertical to a sheet surface in FIG. 1 and the right-and-left direction in FIG. 2) and plural divided-type upper tools with different lengths which are used by suitably combining them. The plural upper tool holder apparatuses 1 are mounted to the upper table 3 with suitable intervals so as to cope with both the above cases.

As is clear from FIG. 1, the upper tool holder apparatus 1 has a holder main body 7, an upper tool clamp 11, clamping force applying means 13 and clamp operating means 15. The holder main body 7 is mounted to the upper table 3 detachably. The upper tool clamp 11 can freely press and fix an upper portion 5U of the upper tool 5 to an upper tool supporting section 9 provided integrally with a lower portion of the holder main body 7. The clamping force applying means 13 applies a clamping force to the upper tool clamp 11. The clamp operating means 15 can transmit the clamping force from the clamping force applying means 13 to the upper tool clamp 11 and release the clamping force.

More specifically, the holder main body 7 is formed so that the thin upper tool supporting section 9 is provided integrally with a lower portion of a thick block section 7B in a front-and-rear direction. A mounting plate 19 which is projected in an upper direction is produced integrally with a front surface (left side surface in FIG. 1) of the block section 7B of the holder main body 7.

An upper projected section of the mounting plate 19 is brought into contact with a front lower portion of the upper table 3, and a clamping jaw 23 is tightened by a clamping bolt 21 threaded into the upper table 3 so that the upper projected section of the mounting plate 19 is pressed and fixed to the upper table 3. As a result, the holder main body 7 can be mounted to the upper table 3.

Figure 4:
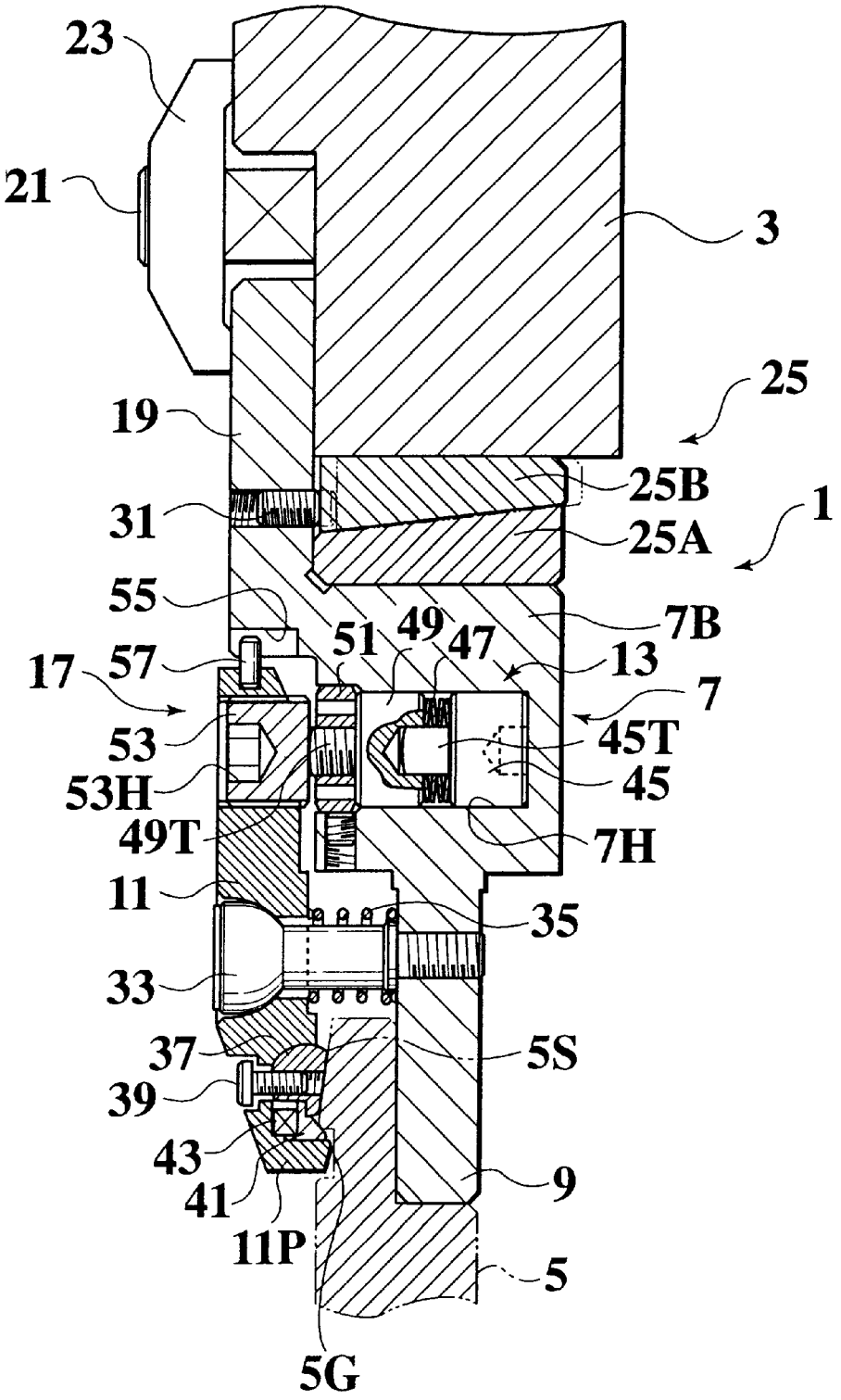
FIG. 4 is a side sectional view of the upper tool holder apparatus of the present invention showing a clamped state.

In order to adjust an up-and-down position (height position) of the holder main body 7, a wedge member 25 intervenes between an upper surface of the holder main body 7 and a lower surface of the upper table 3. Namely, the wedge member 25 is provided on the upper surface of the holder main body 7 by a pin 27 and is composed of a lower wedge member 25A and an upper wedge member 25B. The lower wedge member 25A is slanted high from a left side to a right side in FIG. 1. The upper wedge member 25B, which is slanted low from the right side to the left side, slides between the lower wedge member 25A and the upper table 3 in the right-and-left direction in FIG. 1 by means of a pulling bolt 29 and plural pushing bolts 31 which is shown in FIG. 2 and FIG. 4.

More specifically, the upper wedge member 25B slides in the left direction in FIG. 1 by means of the pulling bolt 29 when the pulling bolt 29 is screwedly tied up. On the other hand, the upper wedge member 25B slides in the right direction in FIG. 1 by means of the plural pushing bolts 31 as shown in FIG. 4. When the pulling bolt 29 is screwedly tied up in the mounting plate 19, so that the upper wedge member 25B slides in the right direction in FIG. 4 as shown by two dotted phantom line, so as to move the mounting plate 19 downwardly in FIG. 4 through the lower wedge member 25A.

Therefore, the pulling bolt 29 and the pushing bolts 31 are operated so that the upper wedge member 25B slides with respect to the lower wedge member 25A in the right-and-left direction in FIG. 1. As a result, the height position of the holder main body 7 can be adjusted from the front side, and the height position of the upper tool 5 can be adjusted. Further, the plural upper tool holder apparatuses 1 are mounted so as to adjacent to the upper table 1 so that crowning of the plural upper tools 5 can be adjusted individually from the front side.

The upper tool clamp 11 is composed of a plate-shaped member having a width approximately equal to a width of the right-and-left direction of the holder main body 7. In order to press and fix the upper section 5U of the upper tool 5 between the upper tool supporting section 9 and the holder main body 7, the upper tool clamp 11 is supported to the holder main body 7 so as to be oscillated.

More specifically, a plurality of through holes 11H are provided in a vicinity of the center portion of the up-and-down direction of the upper tool clamp 11, and the upper tool clamp 11 is supported to a head section of a mounting bolt 33 inserted through the through holes 11H and horizontally fitted and fixed into the upper tool supporting section 9 so as to be oscillated. Moreover, a coil spring 35 is elastically mounted between the upper tool supporting section 9 and the upper tool clamp 11 so as to separate them from each other.

Here, in order to oscillate the upper tool clamp 11 smoothly, a contact portion between the head section of the mounting bolt 39 and the through holes 11H is formed into a spherical contact surface.

An engagement projection 11P, which is engaged with a slip-prevention groove 5G formed in an upper portion of the upper tool 5 in the right-and-left direction, is formed on a lower end section of the upper tool clamp 11 so as to be projected to a direction of the upper tool supporting section 9. A pressing section 37, which contacts with a slanted surface 5S of the upper section 5U of the upper tool 5 and presses the upper tool 5 against the upper tool supporting section 9, is provided on a portion of the upper tool clamp 11 which is slightly upper than the engagement projection 11P.

The pressing section 37 is formed into a shape obtained by machining a portion of a peripheral surface of a column into a flat surface. The pressing section 37 is mounted to the lower portion of the upper tool clamp 11 via a plurality of screws 39 so as to slightly pivot.

In addition, a plurality of wedge pieces 41, which can be engaged with the slip-prevention groove 5G of the upper tool 5, are provided on the upper portion of the engagement projection 11P between the pressing section 37 and the engagement projection 11P so as to move forward and backward. A force is always applied to the wedge pieces 41 to a direction where they are engaged with the drop-prevention groove 5G by the function of an elastic member 43 such as a coil spring mounted between the upper tool clamp 11 and the wedge pieces 41.

The movement of the wedge piece 41 due to the applied force is regulated by bringing one portion of the wedge piece 41 into contact with one portion of the pressing member 37, and a slanted surface 41S is formed on a forward end upper surface of the wedge piece 41 so that the wedge piece 41 can be easily engaged with and removed from the drop-prevention groove 5G.

The clamping force applying means 13, which applies a clamping force, for pressing and fixing the upper tool 5 to the upper tool supporting section 9 by means of the pressing section 37 provided on the lower portion of the upper tool clamp 11, to the upper tool clamp 11, is mounted into a hole 7H in the front-and-rear direction provided in the block section 7B of the holder main body 7.

Figure 3:
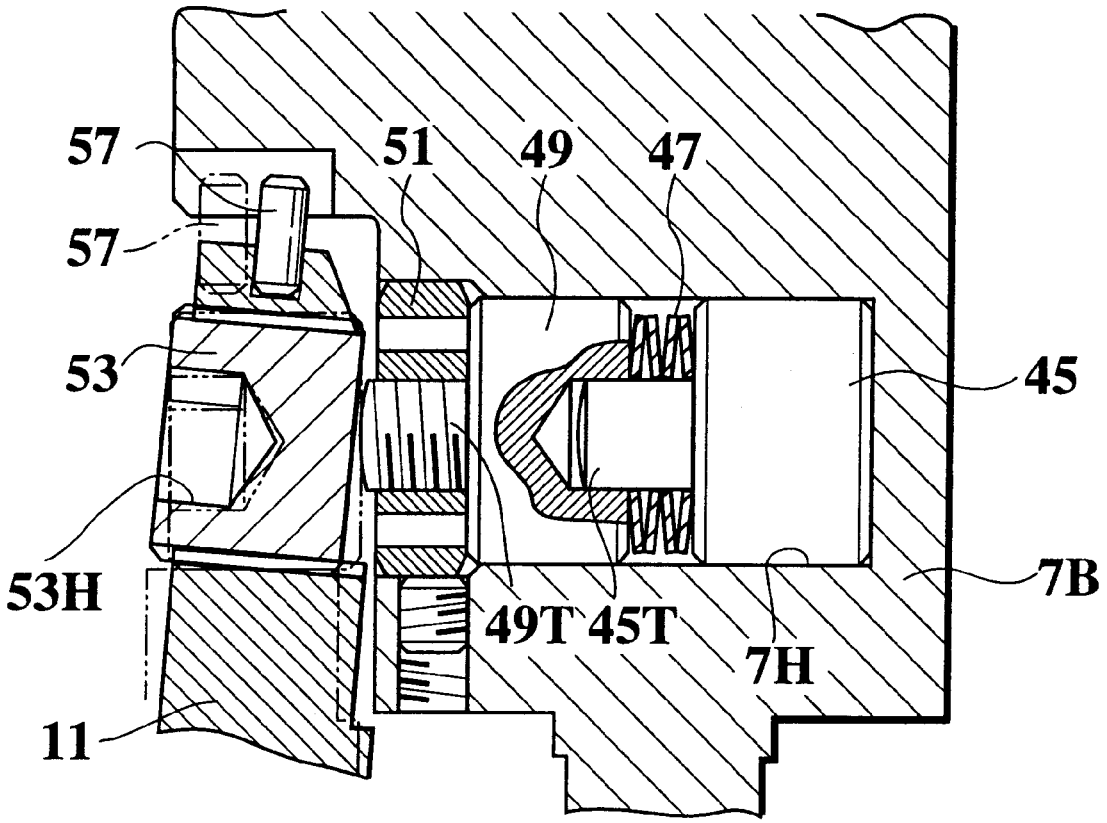
FIG. 3 is an enlarged view in a middle portion of the upper tool holder apparatus of the present invention shown in FIG. 1.

More specifically, as shown in FIG. 3 which shows an enlarged view in a middle portion of the upper tool holder apparatus (especially around the clamping force applying means 13 and the clamp operating means 15), a projection pin 45 is provided in the hole 7H in a left direction in FIG. 3, and a projected section 45T of the projection pin 45 is fitted into another projection pin 49 via a powerful elastic member 47 such as a belleville spring. Moreover, a ring nut 51 is threaded into a projected section 49T of the projection pin 49.

The clamp operating means 15, which transmits the clamping force from the clamping force applying means 13 to the upper tool clamp 11 and releases the clamping force, is provided on an upper side of the upper tool clamp 11.

More specifically, the clamp operating means 15 is provided on the upper portion of the upper tool clamp 11 so as to pivot. Moreover, a pressing screw 53, as a pressing control member which contacts with and removes from the projected section 49T of the projection pin 49, is threaded into the upper portion of the upper tool clamp 11 so as to move forward and backward. A forward end of the pressing screw 53 is brought into contact with the projected section 49T of the projection pin 49.

Therefore, when the pressing screw 53 is pivoted so as to be loosened with respect to the upper tool clamp 11, the pressing screw 53 is removed from the projection pin 49. On the contrary, when the pressing screw 53 is tightened, the pressing screw 53 is slightly brought into contact with the projected section 49T of the projection pin 49. Furthermore, when the pressing screw 53 is further tightened strongly, the pressing screw 53 strongly presses the projected section 49T of the projection pin 49 so as to compress the elastic member 47. As a result, a regenerative force of the elastic member 47 is applied as a reaction force to the pressing screw 53.

The pressing screw 53 is provided with an engagement hole 53H, and one end of an operation lever, not shown, is engaged with the engagement hole 53H.

In addition, as shown in detail in FIGS. 1 through 3, a groove 55 is formed in the front-and-rear direction on an approximately center portion of the right-and-left direction at the lower section of the mounting plate 19, and a right-and-left pivoting prevention member 57 such as a pin, which is engaged with the groove 55, is provided on the upper portion of the upper tool clamp 11.

In the above structure, as the upper tool 5 is shown by an imaginary line, when the upper tool 5 is clamped between the upper tool supporting section 9 of the holder main body 7 and the upper tool clamp 11, the operation lever is engaged with the engagement hole 53H of the pressing screw 53 and is pivoted so that the pressing screw 53 as the pressing control member is tightened. As a result, the elastic member 47 in the clamping force applying means 13 is further compressed.

Therefore, the regenerative force of the elastic member 47 is increased, and the upper tool clamp 11 is pivoted in a counterclockwise direction in FIG. 1 by a reaction force of the regenerative force, namely, in the clamped state shown in FIG. 4. As a result, the upper tool clamp 11 presses and fixes the upper tool 5 more strongly.

On the contrary, when the operation lever is pivoted so that the pressing screw 53 is slightly loosened, the pressing screw 53 is slightly brought into contact with the projected section 49T of the projection pin 49 of the clamping force applying means 13, and the pressed fixing of the upper tool 5 by means of the upper tool clamp 11 is released. As a result, the engagement projection 11P of the upper tool clamp 11 is engaged with the drop-prevention groove 5G, and thus the upper tool 5 is supported movably in the longitudinal direction (right-and-left direction) so as to be in the unclamped state shown in FIG. 1.

When the upper tool 5 is clamped and unclamped by the upper tool holder apparatus 1, the upper tool clamp 11 oscillates in the groove 55 in the front-and-rear direction on the head section of the mounting bolt 33. However, the right-and-left pivoting prevention member 57 can prevent the pivoting of the upper tool clamp 11 in the right-and-left direction.

When the engagement projection 11P provided on the lower portion of the upper tool clamp 11 is engaged with the drop-prevention groove 5G provided on the upper tool 5, the upper tool 5 can be prevented securely from dropping out of the upper tool holder apparatus 1.

In addition, when the clamping force by the clamping force applying means 13 is transmitted to the upper tool clamp 11 by operating the clamp operating means 15, the upper tool clamp 11 presses and fixes the upper tool 5 to the upper tool supporting section 9 of the holder main body 7 firmly, and thus the upper tool 5 can be fixed securely.

Furthermore, since the wedge piece 41, which can be engaged with the drop-prevention groove 5G provided in the upper tool 5, is provided on the upper portion of the engagement projection 11P provided on the lower portion of the upper tool clamp 11 so as to move forward and backward, a clearance between the drop-prevention groove 5G provided in the upper tool 5 and the engagement projection 11P can be reduced. As a result, the dropping of the upper tool 5 can be prevented securely.

When the unclamped state shown in FIG. 1 is changed into the clamped state 17 shown in FIG. 4, a gap between the upper surface of the upper tool 5 and the lower surface of the upper tool supporting section 9 becomes zero. In this state the origin of the lower tool and the upper tool 5 is set and they are aligned so that the setting of the origin and alignment can be executed simultaneously and accurately without requiring additional step of alignment and without breaking the upper tool 5.

In addition, when the holder main body 7 and the mounting plate 19 are produced integrally, they can be mounted to the upper table 3 easily, and more definite accuracy can be secured. Since the height adjusting wedge member 25 for adjusting a height by means of the pushing bolt 31 and the pulling bolt 29 is provided between the upper table 3 and the holder main body 7, in the case particularly where the upper tool holder apparatuses 1 are used with them being arranged adjacently to each other, the height of the upper wedge member 25B is adjusted from the front side with respect to the lower wedge member 25A by the pushing bolt 31 and the pulling bolt 29, and simultaneously crowning can be also adjusted. The length of the upper tool holder apparatus 1 in the right-and-left direction may be 25, 35, 40 and 50 mm, for example, and the upper tool holder apparatuses 1 with these lengths can be used individually, or a plurality of them are used with intervals, or they are used adjacently to each other. At this time, the one upper tool 5 are used or divided upper tools 5 are used.

The entire contents of Japanese Patent Application P10-239155 (filed Aug. 25, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. An upper tool holder apparatus in a press brake, comprising:

a holder main body to be mounted detachably to an upper table in a press brake, the holder main body having an upper tool supporting section for supporting an upper tool, a lower portion of the holder main body, the holder main body further having a mounting plate which is pressed and fixed to an upper table at an upper front surface of the holder main body;

an upper tool clamp supported by the holder main body, the upper tool clamp having an engagement projection at a bottom tool clamp, the engagement projection being engaged with a drop-prevention groove provided in the upper tool;

a pressing section is provided on a lower portion of the upper tool clamp, the pressing section pressing the upper tool against the upper tool supporting section;

clamping force applying means for applying a clamping force which clamps the upper tool by pressing an upper portion of the upper tool clamp, the clamping force applying means being provided on the holder main body;

clamp operating means for transmitting the clamping force from the clamping force applying means to the upper tool clamp and for releasing the clamping force; and a wedge piece, which is engaged with the drop-prevention groove provided in the upper tool, provided on an upper portion of the engagement projection provided on the lower portion of the upper tool clamp, a force being applied to the wedge piece in a direction where it moves into engagement and out of engagement with the drop-prevention groove, wherein a groove is forced on a lower portion of the mounting plate; and wherein a pivoting prevention member which is engaged with the groove is provided on an upper portion of the upper tool clamp.

2. An upper tool holder apparatus in a press brake according to claim 1, wherein the mounting plate and the holder main body are integral with each other.

3. An upper tool holder apparatus in a press brake according to claim 1, wherein a height adjustment wedge member for adjusting a height by means of a pushing bolt and a pulling bolt is provided between the upper table and the holder main body.

* * * * *